US005842739A

United States Patent [19]

Noble

[11] Patent Number: 5,842,739

[45] Date of Patent: Dec. 1, 1998

[54] ADJUSTABLE BABY HEAD AND BODY SUPPORT

[75] Inventor: Sylvia Noble, Apple Valley, Calif.

[73] Assignee: Forever Children, Apple Valley, Calif.

[21] Appl. No.: 756,025

[22] Filed: Nov. 26, 1996

Related U.S. Application Data

[60] Provisional application No. 60/007,726 Nov. 30, 1995.

[51] Int. Cl.[6] ..... A47D 15/00; A47G 9/00

[52] U.S. Cl. ..... 297/219.12; 5/655; 297/284.9; 297/452.35

[58] Field of Search ..... 5/655, 653; 297/284.9, 297/452.35, 219.12, 230.1; D6/611

[56] References Cited

U.S. PATENT DOCUMENTS

| | | | |
|---|---|---|---|
| D. 257,084 | 9/1980 | Fuller et al. | D6/611 |
| D. 328,683 | 8/1992 | Kalozdi | 5/655 |
| 4,434,513 | 3/1984 | Welch | 5/655 |
| 5,441,328 | 8/1995 | Snyder | 297/284.9 |
| 5,586,351 | 12/1996 | Ive | 5/655 |

*Primary Examiner*—Alexander Grosz
*Attorney, Agent, or Firm*—Townsend and Townsend and Crew LLP

[57] ABSTRACT

The present invention is directed to an improved baby head and body support that may be adjusted for babies of various sizes ranging from infants to toddlers. The baby support includes a main body comprising flexible padding and an upper portion movably coupled to a lower portion for positioning the main body between a baby and a carrier. The support further includes first and second adjustable flaps made of flexible padding and movably coupled to the upper portion of the main body. The flaps are substantially thicker than the main body to provide an effective support between the baby's head and shoulders and the carrier. In particular, the flaps will support an infant's head securely and comfortably. In addition, since the flaps can be moved inwardly and outwardly relatively to the main body, they can be adjusted to the changing sizes of the baby as he/she grows into a toddler.

19 Claims, 2 Drawing Sheets

ADJUSTABLE BABY HEAD AND BODY SUPPORT

This application is a Continuation of Provisional Application Ser. No. 60/007,726, filed on Nov. 30, 1995, and now abandoned.

BACKGROUND OF THE INVENTION

As any new parent knows, babies, particularly infants, grow extremely fast, often making it difficult for parents to keep up with this rapid growth. In particular, infant and baby carriers, such as strollers, car seats, swings and the like, can be problematic for parents because babies generally must use these carriers from birth until they are at least a few years old. During this period, babies can grow from a small infant of 5–12 lbs to a relatively large toddler of 30 to 40 lbs.

Rather than buying many different carriers as their child grows, parents typically buy a relatively large sized carrier and improvise by providing additional support around the child until the child grows into the carrier. To facilitate this improvisation, baby head and body supports have recently been developed. These baby head and body supports are padded covers designed to fit between the baby and the carrier to provide cushioned bumper that supports and comforts the baby when he/she is too small to fit within the carrier.

SUMMARY OF THE INVENTION

The present invention is directed to an improved baby head and body support that may be adjusted for babies of various sizes ranging from infants to toddlers. The baby support includes a main body comprising flexible padding and having an upper portion movably coupled to a lower portion for positioning the main body between a baby and a carrier. The support further includes first and second adjustable flaps made of flexible padding and movably coupled to the upper portion of the main body. The flaps are substantially thicker than the main body to provide an effective support between the baby's head and shoulders and the carrier. In particular, the flaps will support an infant's head securely and comfortably. In addition, since the flaps can be moved inwardly and outwardly relatively to the main body, they can be adjusted to the changing sizes of the baby as he/she grows into a toddler.

To position the baby support within the carrier, the lower portion is partially folded towards the upper portion so as to conform to the carrier and the baby in the sitting position. In a specific configuration, the main body defines first and second slots extending inward from either side of the main body between the upper and lower portions. When the upper and lower portions are in the partially folded position, the slots allow the first and second flaps to move between a first position, where the flaps are closer together, and a second position, where the flaps are spaced farther apart. In the first position, the flaps are urged close together to provide the necessary head and shoulder support for infants. In the second position, the lower portion applies a slight amount of pressure to the front side of the flaps to urge the flaps outward into a relatively expanded configuration to accommodate a larger baby or toddler.

In an exemplary embodiment, the lower portion of the main body includes a seat cushion having a substantially greater amount of flexible padding than the remainder of the main body. The seat cushion adds lift and provides better back support, particularly in the baby's first few months of life.

DETAILED DESCRIPTION OF THE PREFERRED EMBODIMENTS

Figure 1:
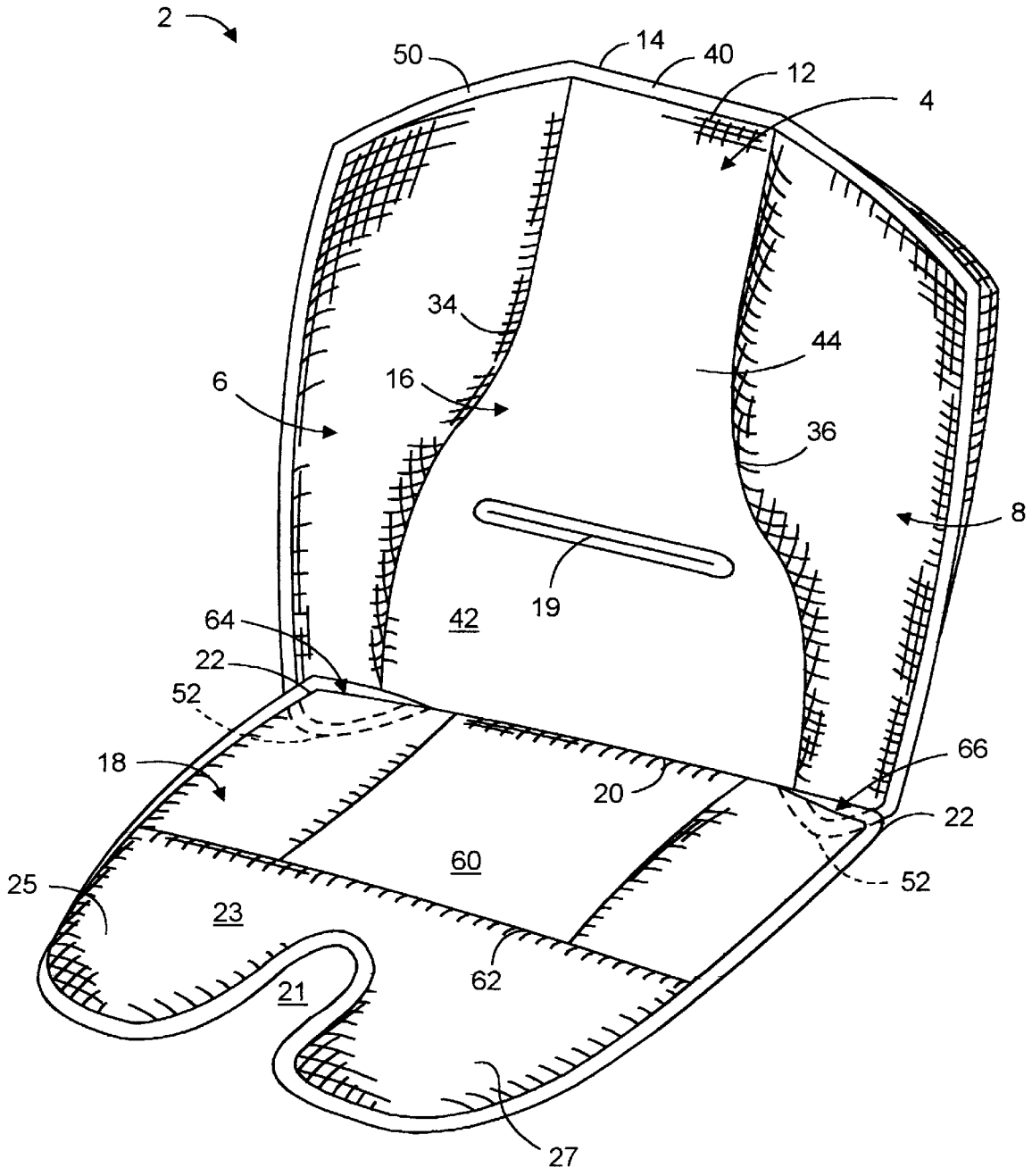
FIG. 1 is a schematic view of a baby head and body support according to the principles of the present invention in a partially folded position for positioning in a car seat and in an expanded configuration for accommodating larger babies.

Referring to the drawings in detail, wherein like numerals indicate like elements, a universal baby head and body support 2 is illustrated according to the principles of the present invention. Universal baby support 2 generally includes a main body 4 and first and second adjustable flaps 6, 8 movably attached to main body 4 for adjusting the size of baby support 2 to correspond with the baby's growth. Universal baby support 2 is adapted for placement between a baby and a carrier (not shown), such as a car seat, infant carrier, convertible car seat, swing, stroller or the like, to form a cushioned bumper between the baby and the infant carrier. Baby support 2 is easily adjustable so that it will be suitable for use with babies ranging from newborns, on the order of 5–12 lbs, to large toddlers, on the order of 30–40 lbs, thereby providing a secure and comforting fit for the baby as he/she grows into the carrier.

Figure 2:
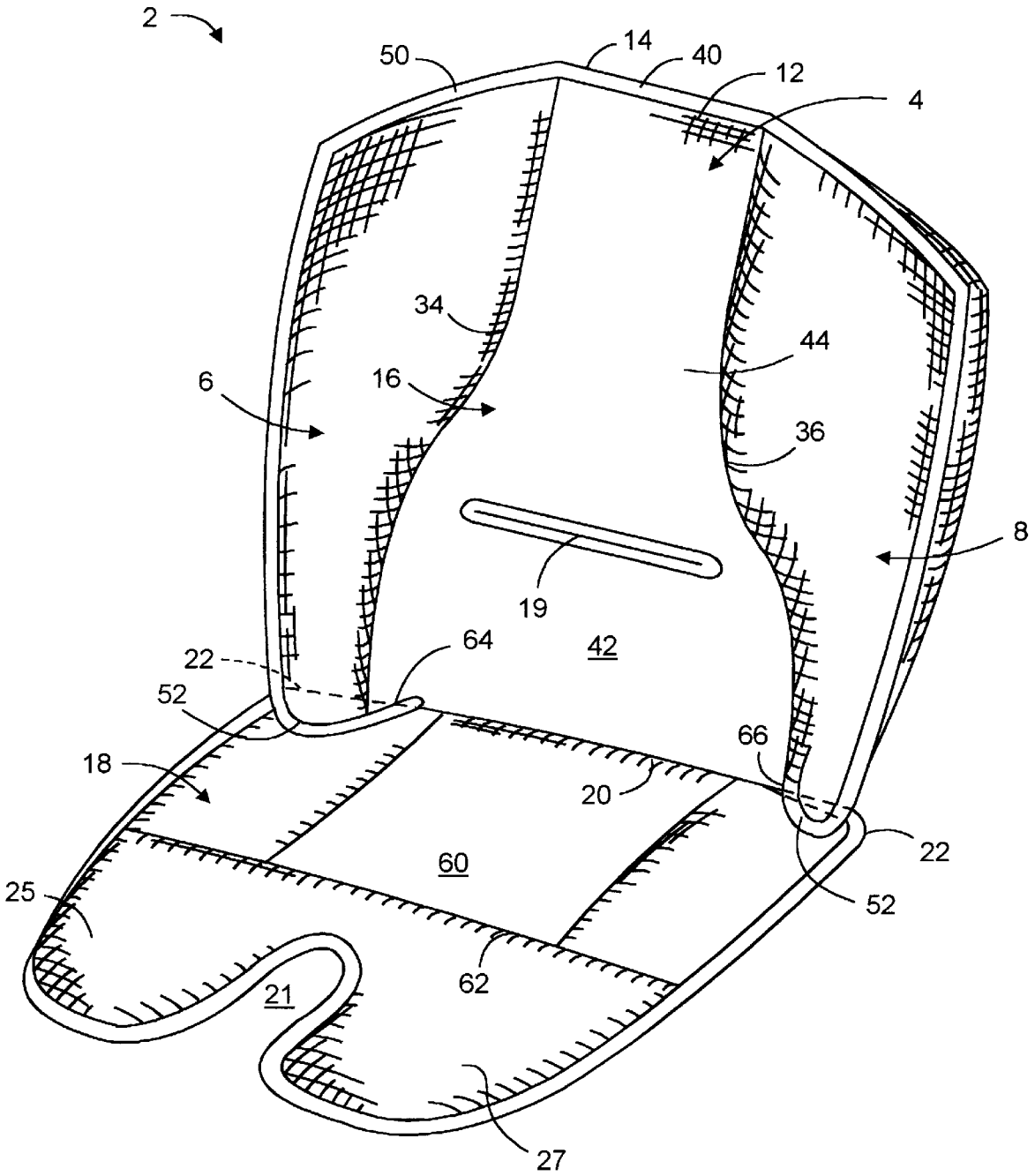
FIG. 2 is a schematic view illustrating the baby support of FIG. 1 in the partially folded position and in a collapsed configuration for accommodating infants.

As shown in FIG. 1, main body 4 generally comprises flexible padding contained within a cover 12 via stitching 14 around the perimeter of cover 12. The flexible padding preferably comprises a polyester filler material, such as standard 1 ounce polyester fiberfill. Alternatively, the flexible padding may comprise foam padding, soft rubber, or other suitable cushioning material. Cover 12 will be any type of soft cloth or fabric material that is comfortable, preferably one that can be washed. Main body 4 comprises an upper portion 16 sized to conform to a baby's head, shoulders and upper back (not shown) and a lower portion 18 sized to conform to a baby's lower back, behind and legs (also not shown). Upper portion 16 has a lower side 20 movably coupled to upper side 22 of lower portion 18 so that baby support 2 can be folded to fit between a carrier, and a baby in the sitting position, as shown in FIGS. 1 and 2. Preferably, upper and lower portions 16, 18 will be separated by stitching 24 running generally perpendicular to the to length of baby support 2.

In an exemplary configuration, upper portion 16 may be folded completely over lower portion 18 to facilitate storing and transportation of baby support 2. In addition, upper and lower portions 16, 18 may be folded into a planar configuration or any configuration therebetween. This flexibility allows the parent to adjust the baby support 2 to any angle so that it will easily accommodate different types of car carriers or strollers.

Baby support 2 is configured to accommodate the seat belt buckle and straps (not shown) of conventional carriers, such as car seats, strollers and the like. As is well known in the art, these seat belts typically comprise a pair of straps extending from an upper portion of the carrier and designed to fit around the baby's head. The straps are usually connected to a single buckle that engages the seat belt holder near the bottom of the carrier. Accordingly, upper portion 16 of main body 4 includes a slit 19 for allowing the seat belt straps and buckle to pass through slit 19 and over the baby. Slit 19 is preferably a single slit sized to accommodate both straps so that the user can simply pull the buckle therethrough. Main body 4 may, of course, include two or more slits, if desired. Upper portion 16 defines a relatively flat upper side 40 that allows the seat belt straps and buckle to be tucked behind it, preventing the buckle from falling forward when inserting and removing the baby. In addition, lower portion 18 includes a longitudinally extending cut 21 in a lower surface 23 that defines first and second seat belt flaps 25, 27 for fitting main body 4 around the seat belt holder.

As shown in FIG. 1, baby support 2 further includes first and second adjustable flaps 6, 8 movably attached to sides 34, 36, respectively, of upper portion 16. Preferably, flaps 6, 8 will be separated from main body 4 via stitching and, similar to main body 4, adjustable flaps 6, 8 are each constructed of a flexible padding contained within a cover. Flaps 6, 8 will have substantially more padding/square inch than the padding/square inch within main body 4 so that flaps 6, 8 are substantially thicker and slightly more rigid than main body 4. Flaps 6, 8 will usually be about 2 to 10 times thicker than main body 4 and preferably about 3–7 times thicker. In a preferred configuration, for example, the entire main body comprises a layer of fabric having dimensions of 24 ½"×17" and each flap 6, 8 will have a layer of fabric having dimensions of 36"×7". With this configuration, flaps 6, 8 provide support around the baby's head and shoulders to help hold the baby upright within a car carrier, stroller, etc. Flaps 6, 8 are also movable with respect to main body 4 so that they can be adjusted depending on the size of the baby. Thus, as the baby grows, flaps 6, 8 will be moved outward to accommodate the baby's larger head and shoulders.

As shown in FIG. 1, upper portion 16 of main body 4 gradually tapers from lower side 20 to an upper side 40 to form a lower, shoulder portion 42 and an upper head portion 44. Flaps 6, 8 also each taper from lower ends 52 to a top surface 50 to correspond to the taper of upper portion 16. Upper head portion 44 has a width sized slightly larger than the baby's head so that flaps 6, 8 will be in close proximity to the sides of the baby's head. Usually, head portion 44 will have a width in the range of 10 to 16 cm and preferably between 12 to 14 cm. Lower shoulder portion 42 has a substantially larger width than head portion 44 to conform to the baby's shoulder's and upper back. At its greatest width (near lower side 20 of upper portion 16), shoulder portion 42 will usually have a width of about 25–40 cm and preferably about 28–32 cm. In this manner, the upper portion 16 of main body 4 conforms to the baby's head and shoulders to provide a snug, comfortable fit and to adequately support the baby's head and shoulders within the carrier. Of course, the above dimensions may vary to accommodate the different sizes of children and toddlers.

Lower portion 18 of main body 4 includes a seat cushion 60 has more flexible padding than the rest of lower portion 18 for adding lift and providing back support to the baby, particularly in the first few months of life. Usually, seat cushion 60 is about 1.5 to 4 times thicker than the rest of lower portion 18, and preferably about 1.5 to 2 times thicker. Seat cushion 60 will preferably have a width of about ⅓ to ¾ the width of lower portion 18 and a length of about ¼ to ⅔ the length of lower portion 18 (including the length of seat belt flaps 25, 27). Seat cushion 60 can be formed by stitching around one or more sides 62 of cushion 60 and inserting a second layer of flexible padding therein.

As shown in FIGS. 1 and 2, main body 4 defines first and second side slits 64, 66 between upper side 22 of lower portion 18 and lower ends 20, 52 of upper portion 16 and flaps 6, 8, respectively. When the baby support 2 is partially folded and positioned within a carrier, side slits 64, 66 provide greater mobility for flaps 6, 8 relative to main body 4. Specifically, flaps 6, 8 are movable between a first position (FIG. 2), where the lower ends 52 of flaps 6, 8 are positioned in front of lower portion 18, and a second position (FIG. 1), where the lower ends 52 of flaps 6, 8 are positioned behind lower portion 18. In the first position (FIG. 2), lower portion 18 applies a slight amount of pressure to the rear side of flaps 6, 8 to urge the flaps inward and provide a more snug fit around the baby. This configuration is particularly useful for infants because they are generally smaller and require more head and shoulder support. Usually, flaps 6, 8 will define an angle of about 30 to 90 degrees, and preferably about 40 to 70 degrees, with upper portion 16 in the first position. In the second position (FIG. 1), lower portion 18 applies a slight amount of pressure to the front side of flaps 6, 8 to urge the flaps outward into a relatively expanded configuration. Usually, flaps 6, 8 will define an angle of about 0 to 45 degrees, and preferably about 10 to 30 degrees, with upper portion 16 in the second expanded position. This expanded configuration accommodates the baby as he/she grows.

Although the foregoing invention has been described in detail for purposes of clarity of understanding, it will be obvious that certain modifications may be practiced within the scope of the appended claims.

What is claimed is:

1. A baby head and body support comprising:

a main body comprising flexible padding and having an upper portion pivotally coupled to a lower portion for positioning the main body between a baby and a carrier, the lower portion including a seat portion having a substantially greater amount of flexible padding than a remainder of the lower portion of the main body for adding lift and providing back support to the baby; and first and second flaps movably coupled to the upper portion of the main body for providing adjustable support to the baby's head and upper body, the flaps comprising flexible padding and being substantially thicker than the main body.

2. The support of claim 1 wherein the first and second flaps are movable between a first position, where the flaps are closer together, and a second position, where the flaps are spaced farther apart.

3. The support of claim 2 wherein the main body defines first and second slots extending inward from first and second sides of the main body between the upper and lower portions, the slots being sized such that, when the upper and lower portions are positioned in the partially folded configuration, the first and second flaps are movable between the first and second positions.

4. The support of claim 3 wherein the lower portion of the main body applies inward pressure to the flaps in the first position to urge the flaps inward towards the upper portion.

5. The support of claim 3 wherein the lower portion of the main body applies outward pressure to the flaps in the second position to urge the flaps away from the upper portion.

6. The support of claim 2 wherein the flaps define an angle of about 30 to 90 degrees with the upper portion of the main body in the first position.

7. The support of claim 2 wherein the flaps define an angle of about 0 to 45 degrees with the upper portion of the main body in the second position.

8. The support of claim 1 wherein the flaps are about 2 to 10 times thicker than the main body.

9. The support of claim 1 wherein the carrier is selected from the group of a car seat, infant carrier, convertible car seat, swing and stroller.

10. The support of claim 1 further comprising an opening in the upper portion of the main body for accommodating one or more seat belt buckles and associated straps of the carrier.

11. The support of claim 10 wherein the opening is a single slit sized to accommodate more than one strap of the carrier.

12. The support of claim 1 wherein the upper portion of the main body is sized to fit a baby's head, shoulders and upper torso, and the lower portion of the main body is sized to fit the baby's lower torso, behind and at least a portion of the baby's legs.

13. The support of claim 1 wherein the upper portion of the main body has an upper section for accommodating a baby's head and a lower section for accommodating a baby's shoulders and back, the upper portion tapering upwards such that the upper section is more narrow than the lower section.

14. The support of claim 1 wherein the seat portion support is about 1.5 to 4 times thicker than the remainder of the lower portion of the main body.

15. A baby head and body support comprising:

a main body comprising flexible padding and having an upper portion pivotally coupled to a lower portion for moving the main body into a partially folded configuration for positioning the main body between a baby and a carrier; and first and second flaps movably coupled to the upper portion of the main body and having lower ends, the flaps comprising flexible padding and being substantially thicker than the main body;

a slot means for (a) permitting said flaps to move between a first position, where the flaps are closer together, and a second position, where the flaps are spaced farther apart, and (b) causing the flaps to be in continuous contact with the baby as the baby shifts position;

said slot means comprising first and second slots extending inward from first and second sides of the main body between the upper and lower portions.

16. A baby head and body support comprising:

a main body comprising flexible padding and having an upper portion movably coupled to a lower portion for positioning the main body between a baby and a carrier;

first and second flaps movably coupled to the upper portion of the main body for providing adjustable support to the baby's head and upper body, the flaps comprising flexible padding and being substantially thicker than the main body;

the first and second flaps being movable between a first position, where the flaps are closer together, and a second position, where the flaps are spaced farther apart;

the main body defining first and second slots extending inward from first and second sides of the main body between the upper and lower portions, the slots being sized such that, when the upper and lower portions are positioned in the partially folded configuration, the first and second flaps are movable between the first and second positions; and the lower portion of the main body applying inward pressure to the flaps in the first position to urge the flaps inward towards the upper portion.

17. A baby head and body support comprising:

a main body comprising flexible padding and having an upper portion movably coupled to a lower portion for positioning the main body between a baby and a carrier;

first and second flaps movably coupled to the upper portion of the main body for providing adjustable support to the baby's head and upper body, the flaps comprising flexible padding and being substantially thicker than the main body;

the first and second flaps being movable between a first position, where the flaps are closer together, and a second position, where the flaps are spaced farther apart;

the main body defining first and second slots extending inward from first and second sides of the main body between the upper and lower portions, the slots being sized such that, when the upper and lower portions are positioned in the partially folded configuration, the first and second flaps are movable between the first and second positions; and the lower portion of the main body applying outward pressure to the flaps in the second position to urge the flaps away from the upper portion.

18. A baby head and body support comprising:

a main body comprising flexible padding and having an upper portion pivotally coupled to a lower portion for moving the main body into a partially folded configuration for positioning the main body between a baby and a carrier; and first and second flaps movably coupled to the upper portion of the main body and having lower ends, the flaps comprising flexible padding and being substantially thicker than the main body;

the main body defining first and second slots extending inward from first and second sides of the main body between the upper and lower portions, the slots being sized such that, when the upper and lower portions are positioned in the partially folded configuration, the first and second flaps are movable between a first position, where the flaps are closer together, and a second position, where the flaps are spaced farther apart; and the lower portion of the main body applying inward pressure to the flaps in the first position to urge the flaps inward towards the upper portion.

19. A baby head and body support comprising:

a main body comprising flexible padding and having an upper portion pivotally coupled to a lower portion for moving the main body into a partially folded configuration for positioning the main body between a baby and a carrier; and first and second flaps movably coupled to the upper portion of the main body and having lower ends, the flaps comprising flexible padding and being substantially thicker than the main body;

the main body defining first and second slots extending inward from first and second sides of the main body between the upper and lower portions, the slots being sized such that, when the upper and lower portions are positioned in the partially folded configuration, the first and second flaps are movable between a first position, where the flaps are closer together, and a second position, where the flaps are spaced farther apart; and the lower portion of the main body applying outward pressure to the flaps in the second position to urge the flaps away from the upper portion.

* * * * *

UNITED STATES PATENT AND TRADEMARK OFFICE

CERTIFICATE OF CORRECTION

PATENT NO. : 5,842,739

DATED : December 1, 1998

INVENTOR(S) : Sylvia Noble

It is certified that error appears in the above-identified patent and that said Letters Patent is hereby corrected as shown below:

Col. 1 line 4-6 should be deleted and replaced therefor

--"This application claims the benefit of and priority from U.S. Provisional Application No. 60/007,726, filed on November 30, 1995, now abandoned. The disclosure of that provisional application is incorporated herein by reference."--

Signed and Sealed this

First Day of June, 1999

*Attest:*

Q. TODD DICKINSON

*Attesting Officer*

*Acting Commissioner of Patents and Trademarks*